US005966890A

United States Patent [19]

Inman

[11] Patent Number: 5,966,890

[45] Date of Patent: Oct. 19, 1999

[54] BUILDING FRAME STRUCTURE

[76] Inventor: Michael J. Inman, 21626 Kuder Ave., Perris, Calif. 92570

[21] Appl. No.: 09/021,066

[22] Filed: Feb. 9, 1998

[51] Int. Cl.[6] ..... E04H 12/10

[52] U.S. Cl. ..... 52/653.2; 52/655.1; 52/643; 52/92.2; 52/655.2

[58] Field of Search ..... 52/653.1, 653.2, 52/655.1, 648.1, 639, 643, 93.2, 93.1, 92.2

[56] References Cited

U.S. PATENT DOCUMENTS

| | | | |
|---|---|---|---|
| 1,347,808 | 7/1920 | Franklin . | |
| 2,001,215 | 5/1935 | Ruppel . | |
| 3,333,875 | 8/1967 | Tracy . | |
| 3,416,183 | 12/1968 | Martin . | |
| 3,722,028 | 3/1973 | Schoenbrod | 16/91 |
| 3,729,868 | 5/1973 | Burum | 49/381 |
| 3,826,044 | 7/1974 | Armstrong | 49/420 |
| 3,829,999 | 8/1974 | Bernstein . | |
| 3,836,270 | 9/1974 | Chambers . | |
| 4,200,406 | 4/1980 | Fuss | 403/231 |
| 4,335,555 | 6/1982 | Southerland et al. | 403/231 |
| 5,526,614 | 6/1996 | Huang . | |
| 5,556,218 | 9/1996 | Homer . | |
| 5,660,005 | 8/1997 | Tacoma | 52/93.2 |

*Primary Examiner*—Christopher T. Kent
*Assistant Examiner*—Yvonne Horton-Richardson
*Attorney, Agent, or Firm*—Boniard I. Brown

[57] ABSTRACT

A building frame structure has a plurality of frame members having tubular end portions, and a plurality of connectors of respective types having respective arrangements of lugs oriented and adapted for engagement with frame member tubular end portions for interconnection to assemble the frame structure.

15 Claims, 5 Drawing Sheets

BUILDING FRAME STRUCTURE

BACKGROUND AND SUMMARY OF THE INVENTION

The assembly or disassembly of relatively simplified building structures formed of pre-fabricated components of long usually involved multiple components require welding and/or other specialized operations, often requiring a power source not available in remote locations. The assembly and disassembly of such structures are usually time-consuming, not quickly performed, and require special skills.

There has been a need for such a building structure of roughly non-complex structure which is relatively quickly assembled and/or disassembled by persons without particular expertise, requiring no specialized equipment or processes, such as welding or other specialized procedures.

The present invention addresses the foregoing and other problems and shortcomings by providing, for the assembly of a building frame structure, a plurality of frame members including rafters, ridge purlins, roof purlins, studs and eave members, and providing a plurality of connectors of respective types, each respective connector type having a respective arrangement of lugs which are disposed, oriented and adapted for engagement with tubular end portions of respective types of the frame members for interconnection to assemble said building frame structure.

The building structure provided according to the invention is relatively quickly assembled without specialized expertise, and may be disassembled by persons without special expertise.

The frame structure may preferably be disposed and secured on a concrete slab or the like, without footings, and is readily disconnectable from such slab for transport from one location to another. Any appropriate roof and wall materials may be utilized in a completed structure.

DESCRIPTION OF THE PREFERRED EMBODIMENTS

Figure 1:
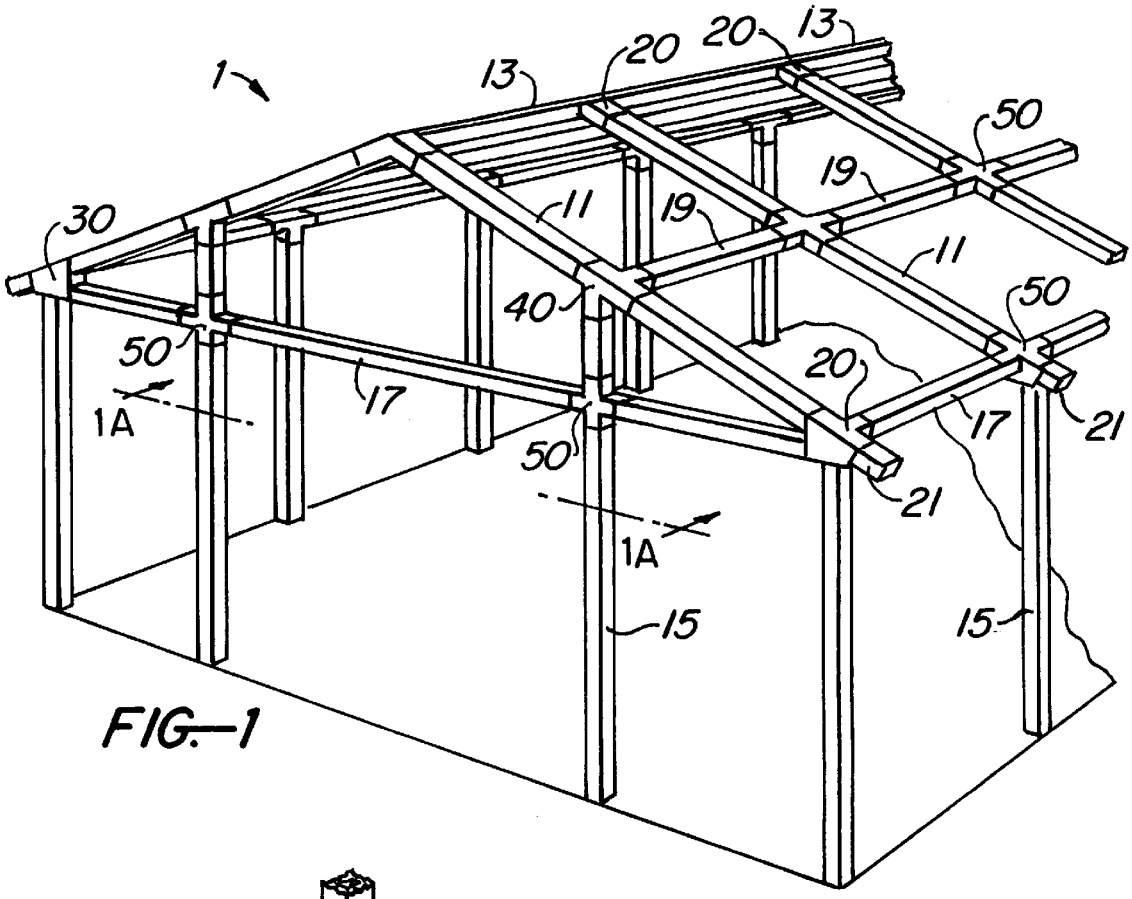
FIG. 1 is an isometric view of an assembled building frame structure, the frame members of which are joined by respective types of connectors according to the present invention.

Referring to the drawings, and particularly to FIG. 1, an assembled frame structure 1 according to the invention, comprises frame members including rafters 11, ridge purlins 13, studs 15, eave members 17 and roof purlins 19. Rafter extensions 21 may also be utilized. As shown, the frame members are interconnected by a plurality of respective types of connectors engaging respective types of frame members.

A plurality of types of connectors are utilized in assembling the frame structure, these being identified as the first through seventh types of connectors.

FIGS. 2 to 11 illustrate connectors according to a preferred form of the invention, which connectors are typically formed by casting of such materials as aluminum, steel, or metallic alloys.

Figure 2:
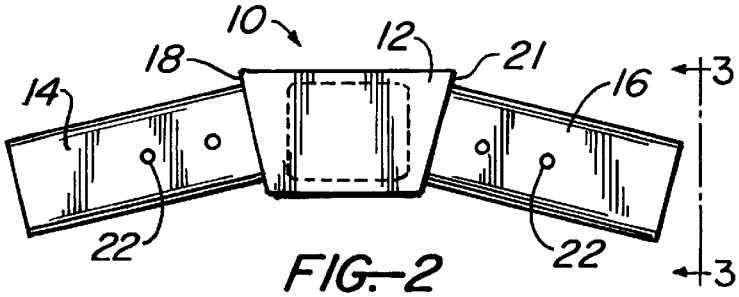
FIGS. 2 to 11 show first through seventh types of respective connectors according to a preferred form of the invention.
Figure 3:
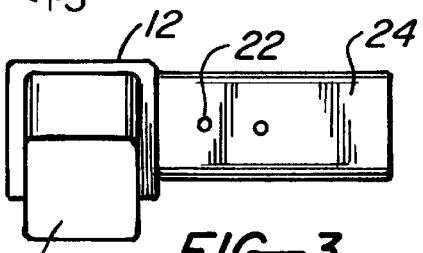

A first type of connector 10 shown in FIGS. 2 and 3, comprises a central portion 12 and two lugs 14, 16 extending oppositely from the central portion with an angle therebetween of typically 150°. The central portion 12 is larger in cross-section than the lugs, and defines shoulders 18, 21 for receiving and positioning of tubular end portions of frame members disposed on the lugs. A lug 24 extends transversely at right angles to the other lugs. Openings 22 are defined in the lugs to receive appropriate fasteners, typically threaded fasteners, to provide improved securement between lugs and frame members, if needed. The openings are not needed in many applications, there being a relatively snug or force-fit between the lugs and the frame members.

Figure 4:
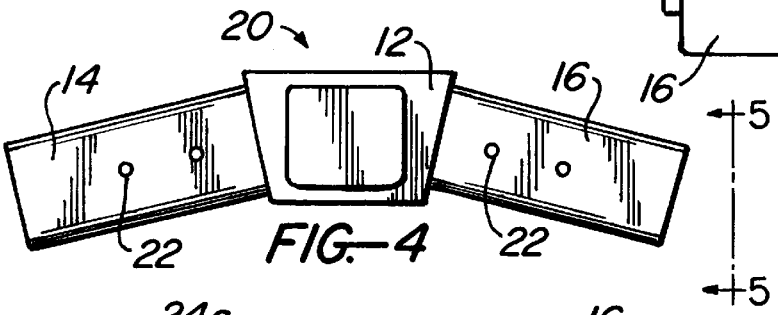
Figure 5:
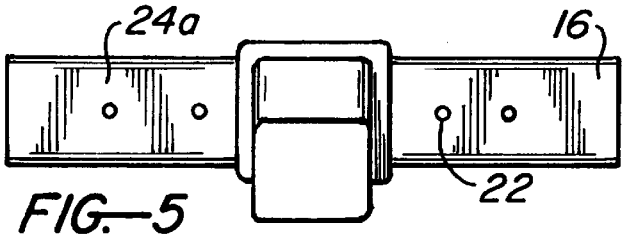

A second type connector 20, shown in FIGS. 4 and 5, comprises components similar to those of the first type connector 10, and similar components bear the same reference numerals as in FIGS. 2 and 3. This second type further includes a lug 24 extending oppositely from and aligned with lug 16 for engagement with ridge purlins 13 on each of lugs 16 and 24*a*.

Figure 6:
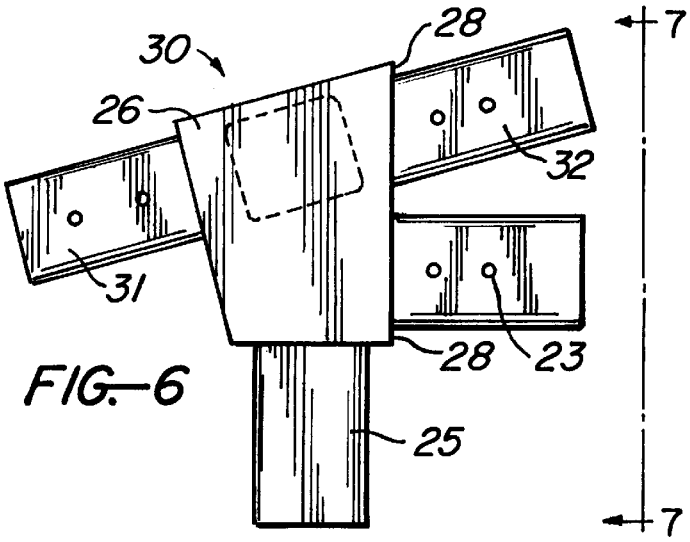
Figure 7:
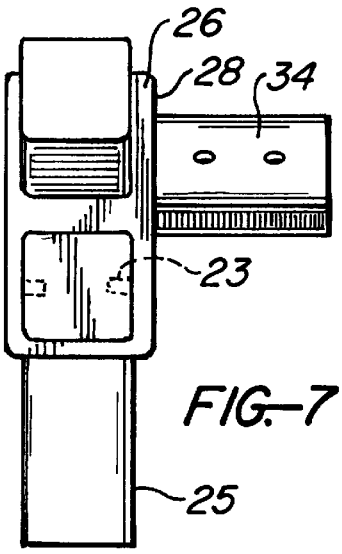

A third type connector 30, shown in FIGS. 6 and 7, comprises two mutually perpendicular lugs 23, 25 joined by a central portion 26 which defines shoulders 28 for receiving and positioning the ends of frame members engaged on the lugs. A pair of oppositely extending inclined lugs 31, 32 extend from central portion 26, as shown, to engage a rafter 11 and a rafter extension 21. A lug 34 extends transversely at right angles to lugs 23, 25 to engage a stud.

Figure 8:
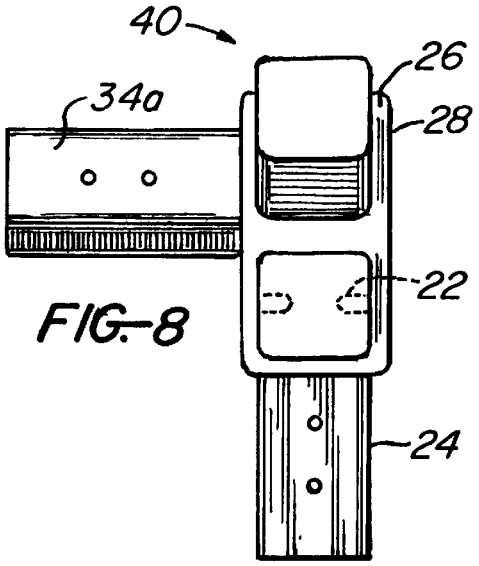

A fourth type connector 40, shown in FIG. 8, has components similar to those of the third type connector of FIGS. 6 and 7, corresponding components being similarly numbered. This fourth type connector has a lug 34*a* extending in the opposite direction from lug 34 of the connector of FIGS. 6 and 7, and lug 34 is eliminated. Lug 34*a* is disposed and adapted to engage an eave member 17 (FIG. 1).

Figure 9:
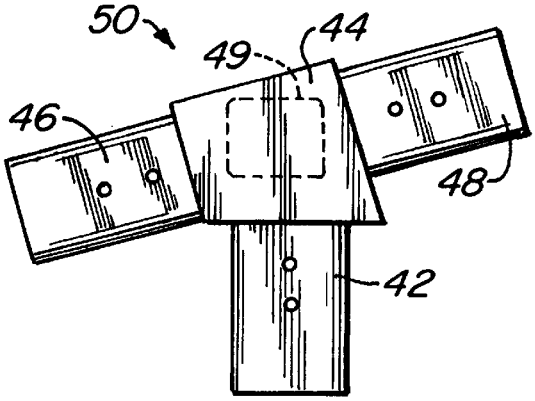

A fifth type connector 50, shown in FIG. 9, comprises a normally vertical lug 42, a central portion 44 defining shoulders, and two oppositely extending lugs 46, 48 which extend oppositely from the central portion at an angle typically of about 15°, as shown, to engage a rafter and a rafter extension. A lug 49 extends transversely and perpendicular to lugs 46, 48 to engage an eave, lug 49 being shown in broken lines.

Figure 10:
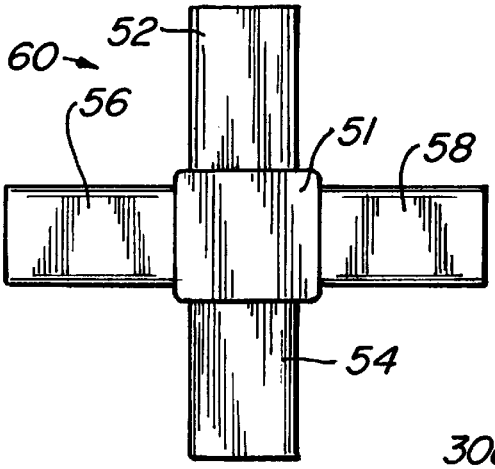

A sixth type connector 60, shown in FIG. 10, has a cross-configuration, with a central portion 51 defining shoulders, two oppositely extending lugs 52, 54, normally vertical, and two lugs 56, 58, normally horizontal, extending oppositely therefrom at right angles.

Figure 11:
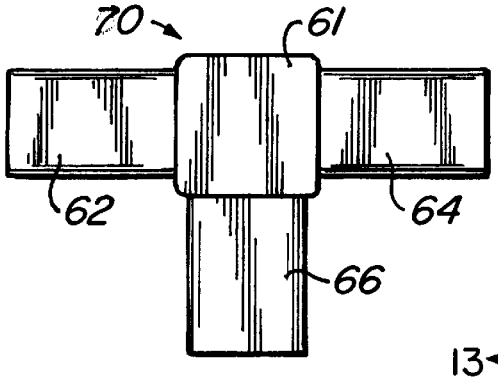
Figure 12:
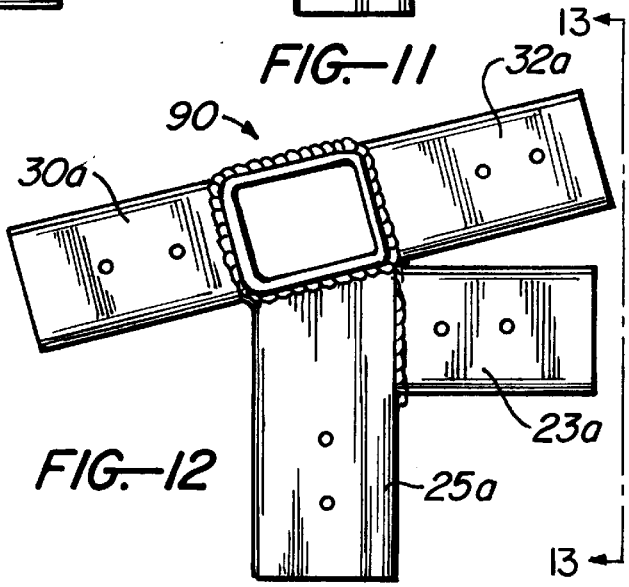
FIGS. 12 to 15 show connectors embodiments of welded, tubular metal construction.
Figure 13:
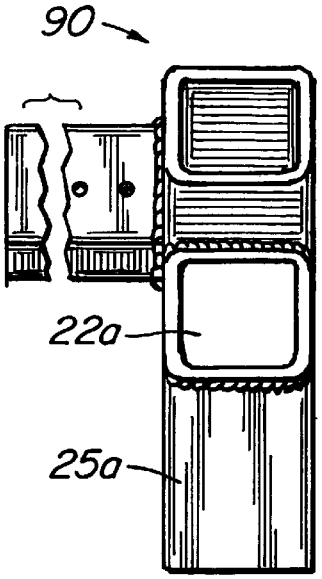
Figure 14:
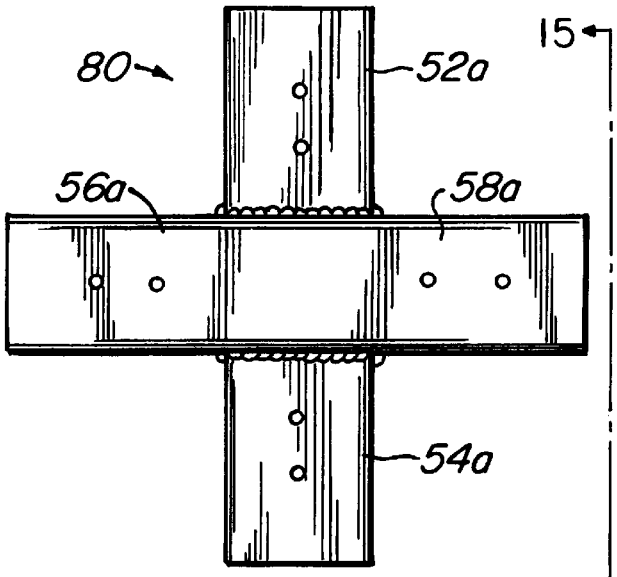
Figure 15:
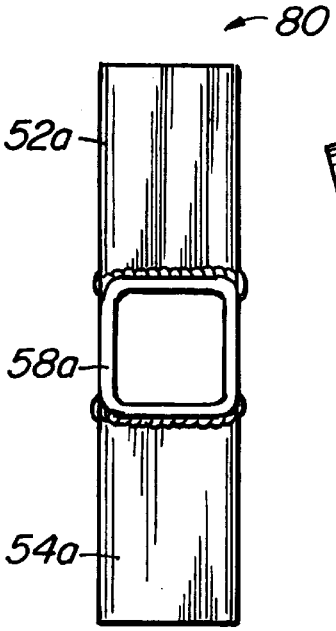
Figure 16:
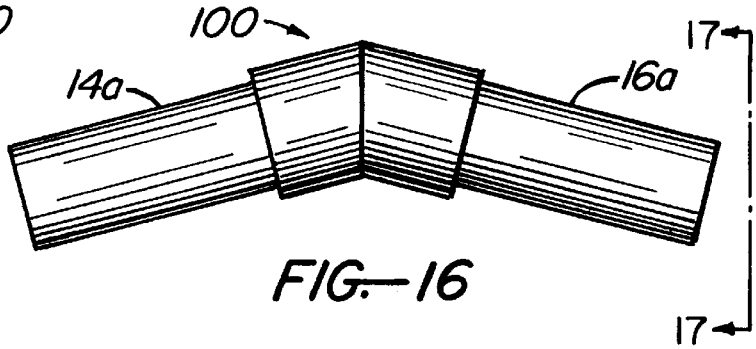
FIGS. 16 to 21 show connectors embodiments of generally tubular construction.
Figure 17:
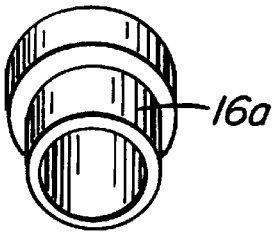
Figure 18:
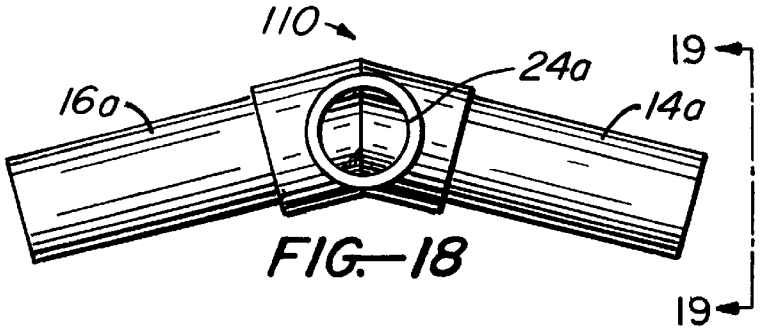
Figure 19:
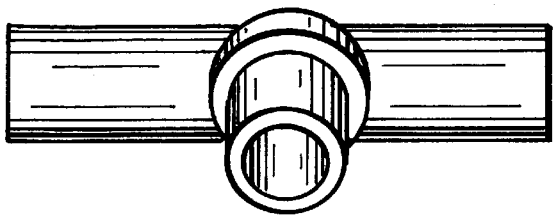
Figure 20:
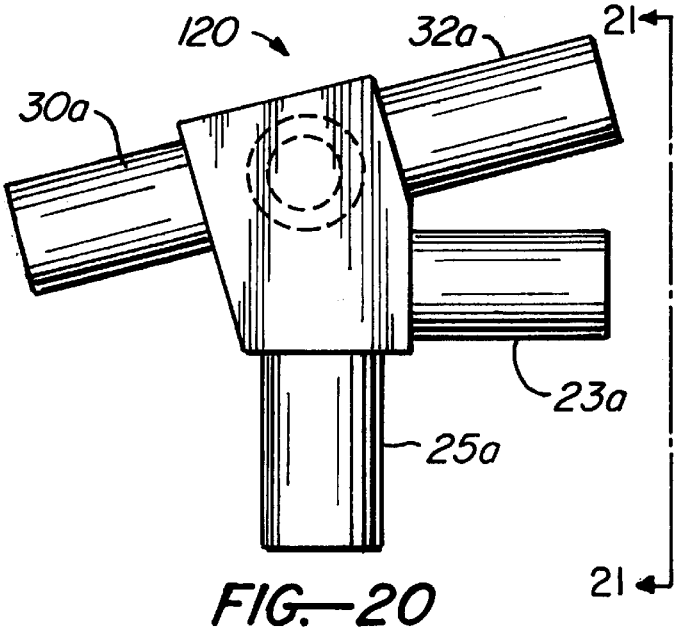
Figure 21:
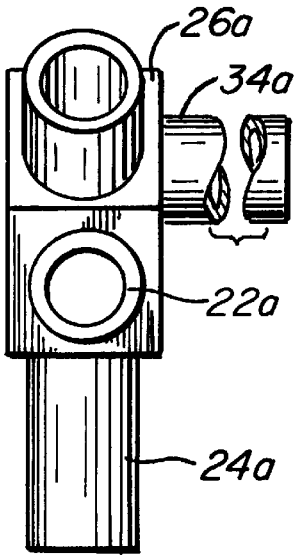

A seventh type connector 70, shown in FIG. 11, has a T-configuration comprising a central portion 61 defining shoulders, a normally vertical lug 66 to receive a rafter, and two lugs 62, 64 extending oppositely from a normally upper end of lug 66, as shown, to receive roof purlins.

Referring to FIGS. 12 to 15, there are shown examples of connectors fabricated, as by welding of appropriate metal. The example 90 of FIGS. 12 and 13 corresponds in general configuration to the embodiment of FIGS. 12 to 15 which is formed by casting in solid form. The embodiment 80 shown in FIGS. 14 and 15 corresponds in general configuration to the embodiment shown in FIG. 10. We understood that other embodiments shown in FIGS. 2 to 11 may be provided in forms produced by welding.

Referring to FIGS. 16 to 21, there are shown three examples 100, 110, 120 of connectors which are of generally cylindrical, tubular construction, tubular portions or components being secured together as by cementing of tubular portions of plastic material, or by welding or other securement of metallic members. The particular embodiments shown in FIGS. 16 to 21 correspond to the embodiments of FIGS. 2 and 3 and FIGS. 6 and 7, respectively. It will be understood that any of the other embodiments shown in FIGS. 2 to 11 may be provided in such cylindrical, tubular construction.

Figure 1A:
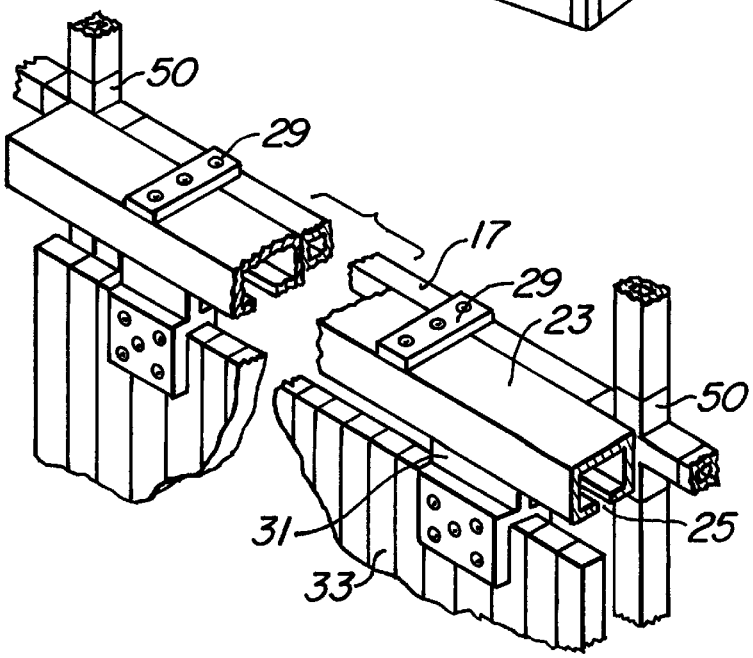
FIG. 1A is a perspective view of a door mounting arrangement utilized with the present invention.

Referring to FIG. 1A, a door arrangement, which may typically be mounted between spaced connectors 50 (FIG. 1) on an eave 17, includes a tubular channel member having a slot 25 in its lower wall and is secured to the eave 17 by mounting straps 29 and by threaded fasteners, as shown. Extending through the slot are roller mounting brackets 31 secured by threaded fasteners to a door 33. Rollers (not shown) mounted on brackets 31, secured on a door 33, are adapted and sized to roll on lower wall portions of the channel member for movement of door 33 between open and closed positions.

Thus there has been shown and described a building frame structure which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A building frame structure comprising:

a plurality of frame members including rafters, ridge purlins, roof purlins, studs, and eave members, the frame members having tubular end portions of substantially rectilinear cross-section, a plurality of connectors of respective types, the connectors of each respective type having a respective arrangement of lug end portions of substantially rectilinear cross-section, disposed, oriented and adapted to engage in the tubular end portions of respective types of frame members for interconnection to assemble the building frame structure, and central portions of at least some of said connectors ending at shoulders to define larger central portions cross-sections than the cross-sections of the lug end portions of the frame members, said lug end portions engaging the tubular end portions of the frame members abutting said shoulders.

2. A building frame structure according to claim 1, wherein:

said lugs are of generally cast construction.

3. A building frame structure according to claim 1, wherein said connectors are of generally tubular welded construction.

4. A building frame structure according to claim 1, wherein:

the connectors lug end portions are of generally cylindrical configuration with open tubular end portions.

5. A building frame structure according to claim 1, and further including:

fasteners extending through the tubular end portions of the frame members and into engagement with said lug end portions.

6. A building frame structure according to claim 1, and further including:

a channel member having a slot in a wall thereof, means for securing the channel member to an eave, a door, and roller means on the door and extensible through said slot for rolling in the channel for the opening and closing of the door.

7. A building frame structure according to claim 2, and further including:

a channel member having a slot in a wall thereof, means for securing the channel member to an eave, a door, and roller means on the door and extensible through said slot for rolling in the channel for the opening and closing of the door.

8. A building frame structure according to claim 3, and further including:

a channel member having a slot in a wall thereof, means for securing the channel member to an eave, a door, and roller means on the door and extensible through said slot for rolling in the channel for the opening and closing of the door.

9. A frame structure according to claim 1, wherein:

the outer surfaces of the central portions of said connectors cooperate with the tubular end sections of the frame members disposed on the lug end portions of the connectors to provide substantially coplanar surfaces comprising surfaces of the central connector portions and the tubular frame members to receive flat building material.

10. A building frame structure comprising:

a plurality of frame members comprising studs, eave members, rafters, roof purlins, and ridge purlins, each of the frame members having generally tubular end portions of tubular cross-section, a plurality of types of connectors interengaging said frame members to receive the tubular end portions of the frame members, said plurality of connectors comprising pluralities of first type connectors, second type connectors, third type connectors, fourth type connectors, fifth type connectors, sixth type connectors and seventh type connectors, each of said connectors having lug end portions to receive thereon said tubular end portions of the frame members, each of said first type connectors having oppositely extending lugs disposed at an internal obtuse relative angle of about 150° for engagement with roof purlins to define a gable, and having a lug extending transversely of the intersection of said extending lugs to engage ridge poles, each of said second type connectors having oppositely extending lugs disposed at its internal obtuse relative angle of about 150° for engagement with ridge poles, and having lugs extending oppositely from the intersection of said lugs and disposed at an internal obtuse relative angle to engage oppositely extending ridge purlins, each of said third type connectors comprising a normally vertical lug to receive a stud, a normally horizontal lug intersecting the vertical lug to receive an eave member, and oppositely extending inclined lugs extending from the intersection of the normally vertical and horizontal lugs to receive rafters, each of said fourth type connectors comprising a normally vertical lug to receive a stud, a normally horizontal lug intersecting the vertical lug and extending in the direction opposite from the horizontal lug of the third type of connector to receive an eave member, and oppositely extending inclined lugs extending from the intersection of the normally vertical and horizontal lugs to receive rafters, each of said fifth type connectors comprising a normally vertical lug to receive a stud, and two lugs extending oppositely at an acute angle relative to and transversely of the direction of the normally vertical lug to receive a rafter and a rafter extension, each of said sixth type connectors comprising four lugs disposed in a cross-configuration to receive rafters on two lugs extending in opposite directions to receive eaves on the two lugs extending oppositely from each other, and each of said seventh type connectors comprising a normally vertical lug to receive a stud, and two lugs extending oppositely to an end of the normally vertical lug to receive eaves, the lugs forming a T-shape configuration.

11. A building frame structure according to claim 10, wherein said lugs are of cast construction.

12. A building frame structure according to claim 10, wherein the connector lugs are of generally tubular welded construction.

13. A building frame structure according to claim 10, wherein:

the connector lugs are of generally cylindrical configuration with tubular end portions.

14. A building frame structure according to claim 10, wherein:

at least some of said connectors have a central portion defining shoulders to abut and position said tubular end portions of frame members.

15. A building frame structure according to claim 10, and further including:

fasteners extending through openings in the tubular end portions of the frame members and into said lugs for positive securement.

* * * * *